US005337667A

United States Patent [19]

Kinoshita et al.

[11] Patent Number: 5,337,667

[45] Date of Patent: Aug. 16, 1994

[54] INK WASHING DEVICE FOR A PRINTING MACHINE

[75] Inventors: Shoji Kinoshita; Hideo Nanbu, both of Gifu; Katsumasa Tanaka, Seki, all of Japan

[73] Assignee: Sakurai Graphic Systems Corporation, Tokyo, Japan

[21] Appl. No.: 43,270

[22] Filed: Apr. 6, 1993

[30] Foreign Application Priority Data

Dec. 28, 1992 [JP] Japan ..... 4-349464

[51] Int. Cl.[5] ..... B41F 35/00

[52] U.S. Cl. ..... 101/424; 101/425

[58] Field of Search ..... 101/423, 424, 425, 148; 239/398, 416.5, 418, 423, 424, 424.5, 426, 433, 434, 434.5

[56] References Cited

U.S. PATENT DOCUMENTS 3,508,711 4/1970 Switall ..... 239/562

3,952,654 4/1976 Evans ..... 101/425

4,241,656 12/1980 Smith ..... 239/434.5

FOREIGN PATENT DOCUMENTS 1-165236 11/1989 Japan .

4-38431 3/1992 Japan .

*Primary Examiner*—Edgar S. Burr

*Assistant Examiner*—Ren Yan

*Attorney, Agent, or Firm*—Hickman & Beyer

[57] ABSTRACT

An ink washing device for use in a printing machine, including a spraying pipe. The pipe comprises a plurality of nozzles for spraying the washing fluid onto an ink roller. The washing fluid is supplied to the nozzle, via a washing fluid supply conduit, and compressed air is supplied to the nozzles, via an air supply conduit. The washing fluid supply conduit and the air supply passage communicate with a swirl chamber. The washing fluid and the compressed air are intermixed within the swirl chamber prior to being dispensed through the nozzles.

12 Claims, 7 Drawing Sheets

INK WASHING DEVICE FOR A PRINTING MACHINE

BACKGROUND OF THE INVENTION

This application claims the priority of Japanese Patent Application No. 4-349464 filed Dec. 12, 1992, which is incorporated herein by reference.

Field of the Invention

The present invention relates to a device for washing the ink rollers of a printing machine. More particularly, the invention pertains to a device capable of automatically washing the ink rollers.

Description of the Related Art

In general, most printed materials, such as pamphlets, catalogs and the like, are normally printed by offset printing machines. Conventional offset printing machines enable multiple color printing, and are suitable for producing large quantity of printed materials. A conventional offset printing machine generally includes a plurality of ink rollers which are disposed between an ink tank and a plate cylinder. The ink rollers convey ink from the ink tank to the plate cylinder. Further, ink is conveyed from an impression cylinder positioned over the plate cylinder to a blanket cylinder, such that printing is carried out by the blanket cylinder.

In such an arrangement, when printing is performed, the peripheral surfaces of the ink rollers tend to be covered by layers of ink. After the completion of the printing operation, or upon changing ink colors, the ink deposited on the rollers must be washed off.

Typically, an operator sprays washing fluid over the ink rollers, in order to wash off the ink. The ink is softened by the washing fluid, and is conveyed to a deposit cylinder, which is adjacent to the plate cylinder, together with the washing fluid. A scrape blade is pressed against the peripheral surface of the deposit roller, in order to scrape off the softened ink. This washing operation is rather cumbersome.

In an attempt to improve the washing operation, an ink washing device, which includes nozzles for automatically spraying the washing fluid has been proposed. In the ink washing device of this type (FIG. 9), the washing fluid stored in a tank 50 is conveyed to a pipe 52, by opening a solenoid valve 54. The washing fluid is sprayed over the peripheral surface of an ink roller 55, by way of a nozzle 51, under pressure from compressed air conveyed via a solenoid valve 54.

However, in this ink washing device, the washing fluid and air within the pipe 52 are separated from each other. The washing fluid mist sprayed from the nozzle 51 is not uniform. Therefore, the washing fluid tends to be sprayed in a non homogeneous way, such that the washing operation might not be satisfactorily achieved.

Further, in this ink washing device, after the washing operation is completed, the solenoid 53 for the washing fluid is deactivated and is caused to close, prior to closing of the solenoid 54 for the air. Therefore, only the compressed air is supplied during a predetermined period of time. The washing fluid left in the distal end of the nozzle 51 is blown away by the compressed air, in order to prevent the washing fluid from dripping- Even after the washing fluid is away, some washing fluid adheres to the inner peripheral surface of the pipe 52.

Therefore, the washing fluid could accumulate in the tip of the nozzle 51.

In the above-described condition, an angle $\theta$ is formed between the surface of the accumulated washing fluid at the tip of the nozzle 51, and the outer peripheral surface of the pipe 52, as illustrated in FIG. 10. The magnitude of the angle $\theta$ depends on the type of material of the pipes and fluids, and their respective temperature.

For example, if the pipe 52 is made of copper and the essential part of washing fluid is light oil, the angle $\theta$ would range between approximately 7° and 10°. As shown in FIG. 10, when fluid adheres to the outer peripheral surface of the pipe 52, an apparent angle $\theta'$ becomes larger than the actual angle $\theta$. At this time, the shape of the fluid drop becomes substantially spherical. Therefore, residual amount of fluid is increased, such that the fluid drips may be increased. When the washing fluid drips on the ink rollers, stain could occur during the next printing operation. This causes the printing quality to be lowered.

SUMMARY OF THE INVENTION

Accordingly, it is a primary object of the present invention to provide an ink washing device for a printing machine, which can perform homogeneous spraying of the washing fluid, so as to achieve high washing efficiency.

Another object of the present invention is to provide an ink washing device for a printing machine, which prevents the washing fluid from dripping, after the washing operation is completed, so as to provide high printing quality.

To achieve the foregoing and the other objects, and in accordance with the purpose of the present invention, an ink washing device for a printing machine is provided, which has at least one nozzle formed on the surface of a pipe, for spraying the washing fluid over the ink rollers. The washing fluid is supplied to the nozzle, via a washing fluid supply conduit, and the compressed air is supplied to the nozzle, via an air supply conduit. A swirl chamber connects the air supply conduit and the washing fluid conduit. The washing fluid and air are mixed within the swirl chamber prior to dispensation through the nozzles.

Consequently, when the washing fluid and air are mixed inside the swirl chamber, the washing fluid is uniformly sprayed over the surface of the ink rollers. As a result, the present invention increases the efficiency of the washing operation.

Furthermore, printing stains can be prevented by providing drip preventing surfaces, which are substantially flat, around each nozzle opening. As a result, the present invention increases the printing quality.

BRIEF DESCRIPTION OF THE DRAWINGS

The invention, together with the objects and advantages thereof, may best be understood by reference to the following description of the preferred embodiments, together with the accompanying drawings, in which.

DETAILED DESCRIPTION OF THE PREFERRED EMBODIMENT

Figure 1:
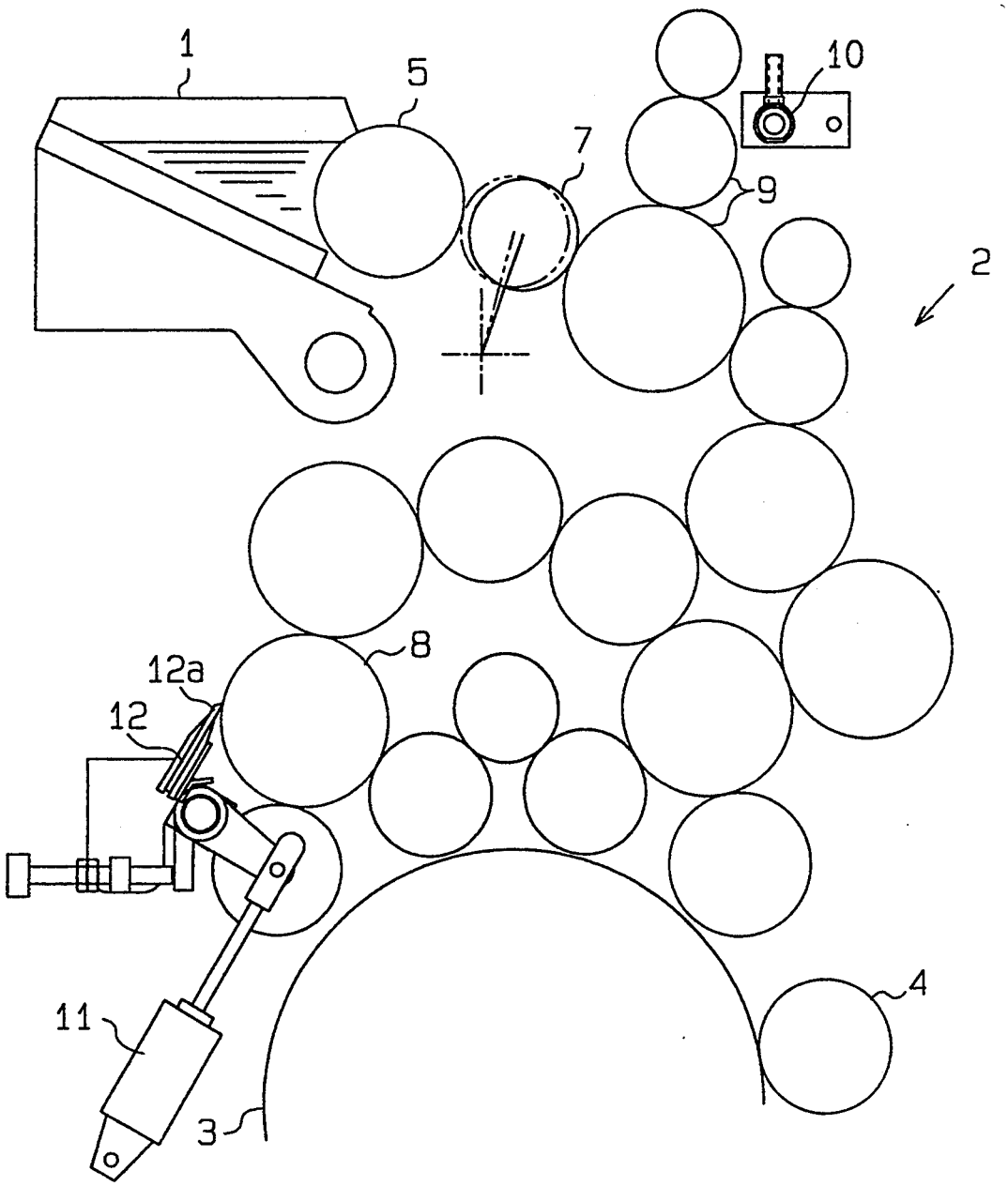
FIG. 1 is a front view of an ink washing device for a printing machine according to the present invention.

A preferred embodiment according to the present invention will now be described, referring to the drawings.

In an offset printing machine as shown in FIG. 1, ink is supplied to a plate cylinder 3 from an ink tank 1, via ink rollers 2. The ink is kneaded with water supplied on the plate cylinder 3, via a water roller 4. The ink stored in the ink tank 1 is conveyed through a base roller 5, and is then transferred to a roller 7. Excessive ink is conveyed to a deposit roller 8 located near the plate cylinder 3, where it is deposited into layers. Further, a spray pipe 10 for spraying the washing fluid is disposed adjacent to ink rollers 9.

Figure 2:
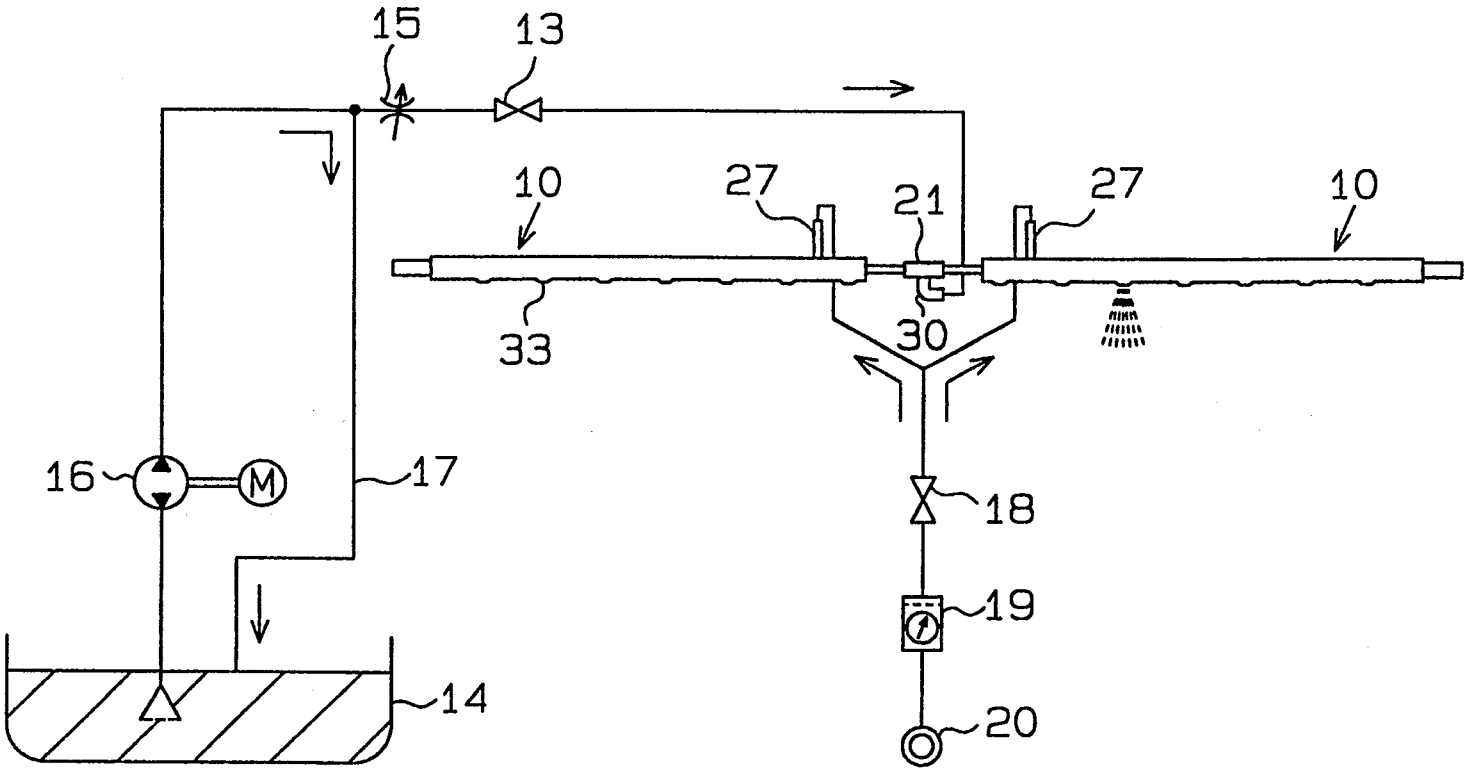
FIG. 2 is a schematic piping layout of an air supply pipe and washing fluid supply pipe used in the ink washing device of FIG. 1.

A piping layout for the washing fluid is shown in FIG. 2. When the washing operation is started, a fluid solenoid valve 13 is opened. Consequently, the washing fluid in a tank 14 is pumped by means of a pump 16. The flow of the washing fluid is controlled to a predetermined level, by means of a restriction mechanism of a variable pressure control orifice 15. Further, when the solenoid 13 is closed, the restriction mechanism of the orifice 15 is no longer functional. Therefore, the washing fluid is returned to the tank 14, via a return pipe 17.

On the other hand, an air solenoid valve 18, in the air supply pipe, is opened synchronously with the solenoid 13. The pressure of compressed air supplied from an air supply 20 is regulated by means of a regulator 19, and is conveyed to the spray pipes 10.

The spray pipe 10 will now be described in detail, referring to FIGS. 3 through 7.

Figure 3:
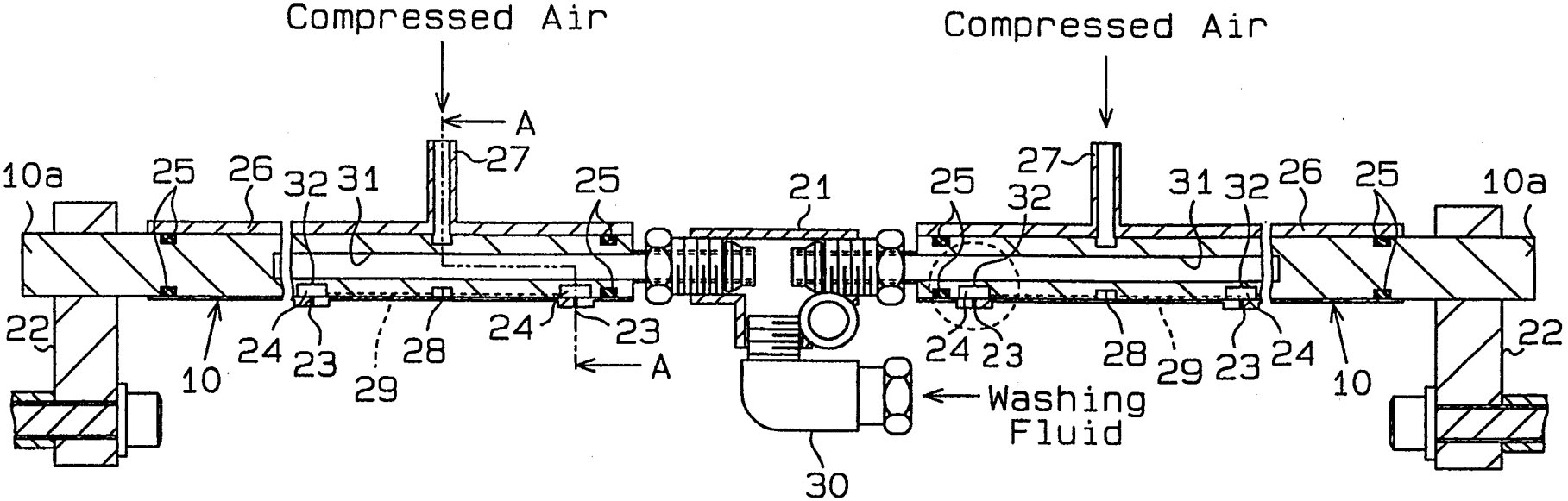
FIG. 3 is a cross-sectional view of a spray pipe of the ink washing device of FIG. 1.

As shown in FIG. 3, two spray pipes 10 are interconnected by means of a joint 21. The joint 21 has a substantially T-shaped cross-section. Each distal end of the paired spray pipes 10 includes a bracket 22 which connects the corresponding pipe 10 to the printing machine (not shown). Each pipe 10 includes a pipe 10*a* and a sleeve 26 which covers most of the outer surface of the pipe 10*a*. Two O-rings 25 are interposed between the pipe 10*a* and the sleeve 26.

Figure 5:
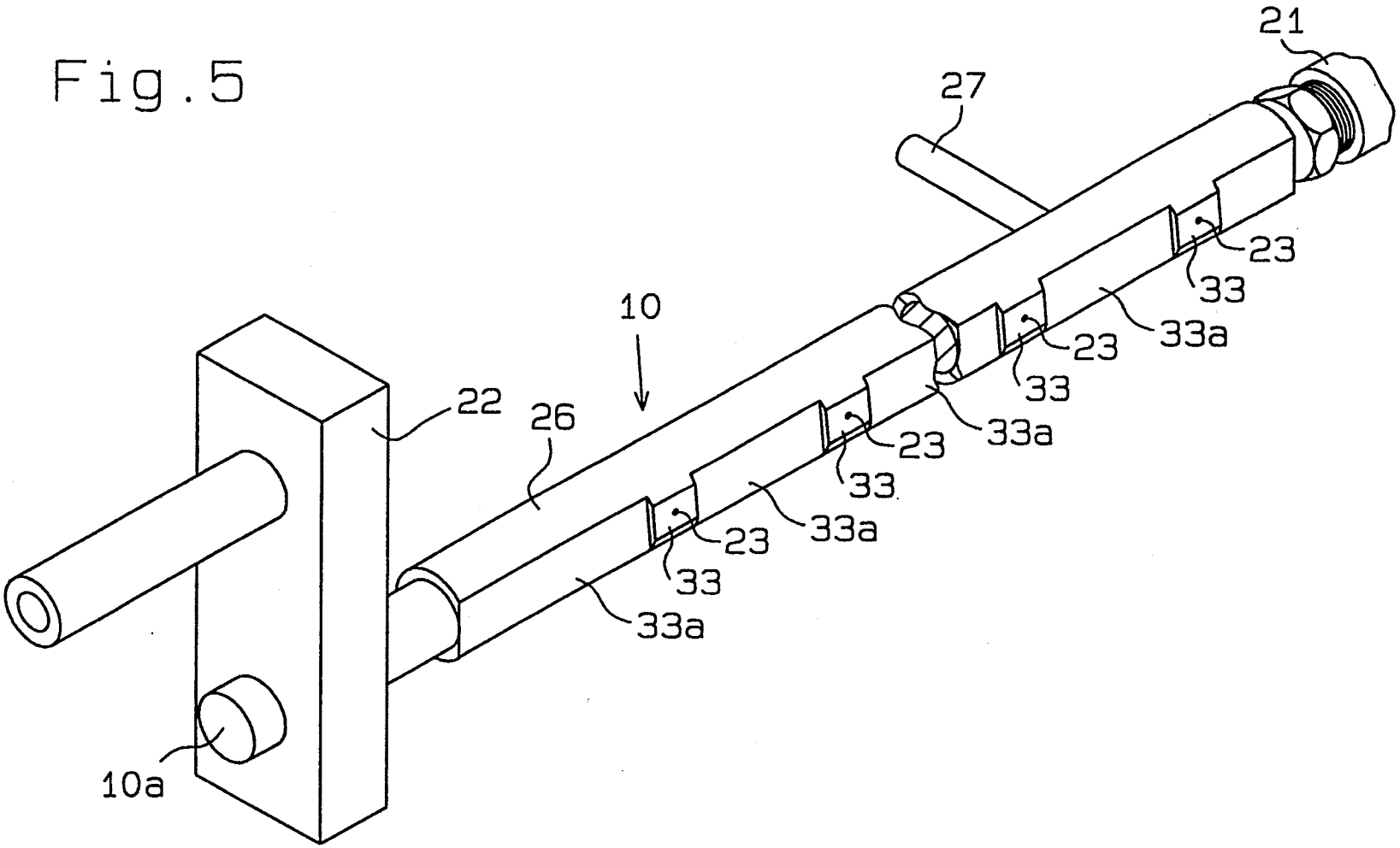
FIG. 5 is a perceptive view of the spray pipe of FIG. 3, shown rotated by 90 degrees, in order to show a plurality of nozzle openings and drip preventing surfaces.

As shown in FIG. 5, a plurality of nozzle openings 23 for spraying the washing fluid are equidistally provided in a row, at predetermined intervals, along the axial length of the sleeves 26. A plurality of drip preventing surfaces 33 are also provided along the axial length of the sleeves 26. Each surface 33 is formed around the associated nozzle opening 23.

The two adjacent surfaces 33 are separated by a generally rectangular and elongated recess 33*a*, that extends along the axial direction of the sleeve 26.

Figure 8:
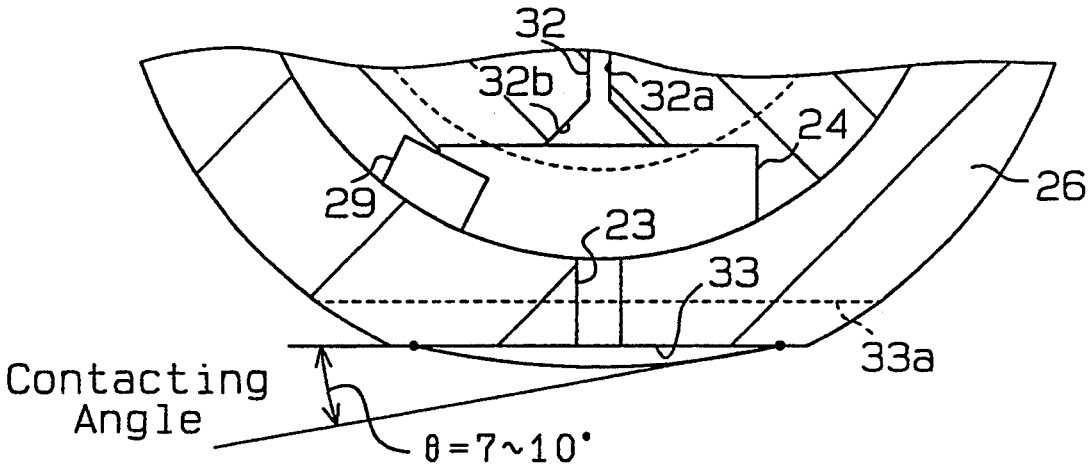
FIG. 8 is a greatly enlarged cross-sectional view illustrating the shape of the nozzle opening of the spray pipe.
Figure 9:
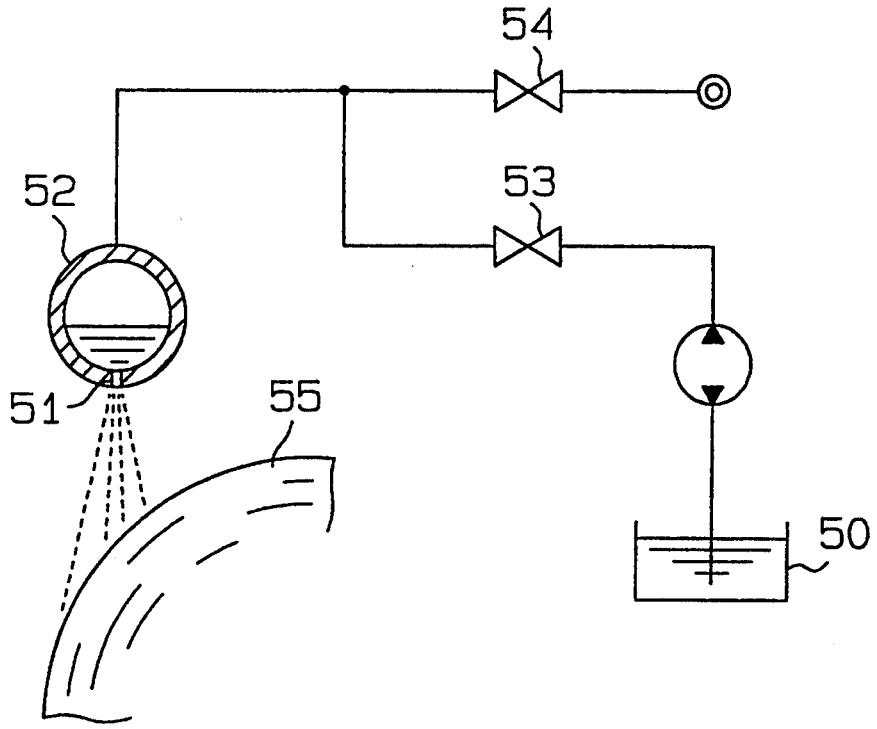
Fig.9 (Prior Art)
FIG. 9 is a simplified schematic view of a pipe arrangement in a conventional ink washing device.
Figure 10:
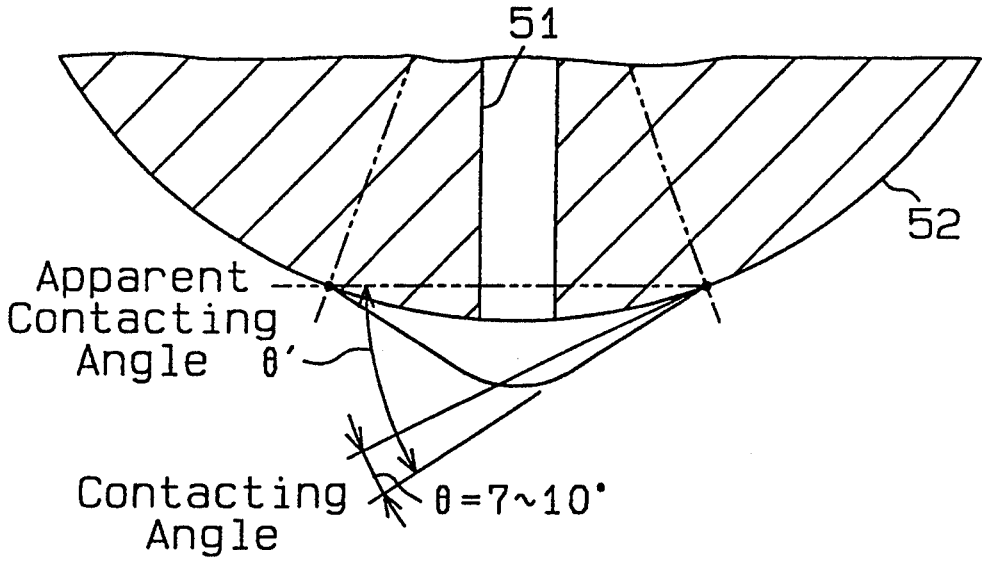
Fig.10 (Prior Art)
FIG. 10 is a greatly enlarged cross-sectional view illustrating the shape of the nozzle opening of a conventional spray pipe.

As further shown in FIG. 8, each surface 33 is a generally horizontally formed surface, which protrudes outwardly, relative to the adjacent recesses 33*a*. When the spraying operation is completed, the residual washing fluid in the opening 23 is accumulated to the associated surface 33, under the effect of the surface tension, such that the contacting angle $\theta$ ranges between 7° and 10°. The residual washing fluid is spread over the surface 33, and the washing fluid is less likely to drip from the surface 33.

As shown in FIG. 3, an air pipe 27 extends radially outwardly from each sleeve 26. A groove 28 is formed along the radial circumference of each sleeve 26, and communicates with the corresponding air pipe 27. An air supply groove 29 is formed along substantially the axial length of the pipe 10*a*, and is connected to the associated circumferential groove 28. Thus, air supplied from the air supply 20, via the solenoid valve 18 (FIG. 2), is conveyed from the air pipes 27 to the air supply grooves 29, via the circumferential grooves 28.

As shown in FIG. 3, an elbow 30 is screwed into the one end of the T-shaped joint 21. The washing fluid pumped by the pump 16 is supplied to the pipes 10*a*, via the elbow 30 and the T-shaped joint 21. The washing fluid supply paths 31 are connected on either side of the T-shaped joint 21 and are formed within the associated pipe 10*a*.

Figure 4:
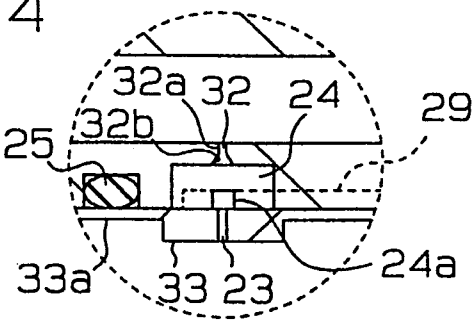
FIG. 4 is a partly enlarged cross-sectional view of a section which is enclosed by dotted circle in the FIG. 3.
Figure 6:
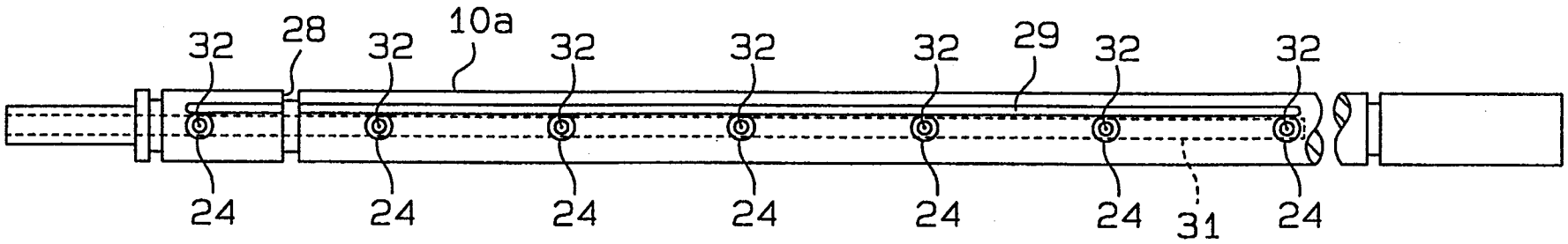
FIG. 6 is a bottom view of a pipe which is a part of the spray pipe and includes air grooves and swirl chambers.
Figure 7:
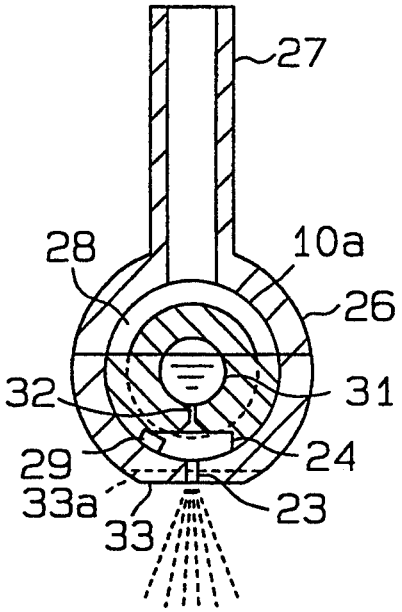
FIG. 7 is a cross-sectional view of the spray pipe of FIG. 3, taken along line A—A.

As shown in FIGS. 4, 6 and 7, a plurality of generally cylindrical shaped swirl chambers 24 are formed along the outer circumferential surfaces of the pipes 10*a*, and are disposed between the washing fluid supply path 31 and the nozzle openings 23. Each air supply groove 29 is connected to the side surface of the associated chamber 24. A swirl is generated when air is supplied from the air supply groove 29 to the associated chamber 24. The chambers 24 in each pipe 10*a*, are fluidly inter connected, via the washing fluid supply path 31, within the pipe 10*a*, and an associated connecting hole 32. Each connecting hole 32 includes narrow section 32*a* which extends into an enlarged section 32*b*. The enlarged section 32*b* terminates into the chamber 24. Therefore, the washing fluid is sprayed into the swirl chambers 24 in a mist form, which is then mixed with the swirling air, and sprayed through the nozzle 23 over the ink rollers 9.

The washing fluid is sprayed through the pipes 10*a* at predetermined intervals, and is conveyed from the ink roller 9 to the deposit roller 8, via ink rollers 2. The layers of ink deposited on the outer circumferential surface of the deposit roller 8 is softened by the washing fluid. At the same time, a blade 12 is activated at predetermined intervals, by an air cylinder 11 disposed in the vicinity of the deposit roller 8. The blade 12 is pressed against the outer circumferential surface of the deposit roller 8, in order to scrape off the ink from its surface.

In the foregoing printing machine, when the washing fluid solenoid valve 13 is opened, the washing fluid stored in the tank 14 is pumped up by the pump 16, and is conveyed to the spray pipes 10. Further, as the air solenoid valve 18 is opened simultaneously with the solenoid 13, air is supplied to the spray pipes 10. As a result, the washing fluid is more uniformly transformed to particles by the effect of the swirl, and is mistily sprayed through the nozzle openings 23. Therefore, the washing fluid is evenly sprayed over the surface of the ink rollers 9. The washing fluid is then evenly conveyed from the ink roller 9 to the entire peripheral surface of each ink roller 2.

At the end of the washing operation, after the fluid solenoid valve 13 is closed, the air solenoid valve 18 is kept open for a predetermined period. As the washing fluid is no longer supplied, and only the air is sprayed through the nozzle openings 23, the residual washing fluid left in the spray pipes 10 is blown away by the compressed air. The solenoid valve 18 is thereafter closed. After air has been sprayed, some washing fluid could accumulate at the openings of the nozzles 23. However, the drip preventing surface 33 can reduce the amount of washing fluid retained thereon. Therefore, the drip preventing surface 33 can prevent the drip of the residual washing fluid.

In the ink washing device according to the present embodiment, since the swirl chamber 24 is provided for mixing the air and the washing fluid, the washing fluid to be sprayed is transformed to smaller particles. Therefore, the air-washing fluid mixture can be evenly sprayed over the surface of the ink roller 9. As a result, the washing fluid is evenly spread over the entire peripheral surface of each roller 2, such that the ink can be evenly removed away from the peripheral surface of the rollers 2. Hence the washing operation is rendered more efficient.

Furthermore, since the drip preventing surface 33 is generally flat, and surrounds the associated nozzle opening 23, the drip of washing fluid can be prevented. Therefore, printing stain caused by the drip of the washing fluid can be significantly reduced, if not entirely prevented.

Although only one embodiment of the present invention has been described herein, it should be apparent to those skilled in the art that the present invention may be embodied in many other specific forms without departing from the spirit or scope of the invention.

For example, the drip preventing surface 33 can be circularly shaped for reducing the amount of residual washing fluid. Alternatively, the surface 33 can be square. In this embodiment, the spray nozzles spray the washing fluid onto two ink rollers 9. These spray nozzles can alternatively spray other ink rollers 2, in addition to the foregoing two ink rollers 9.

Further, this ink washing device can be used in other printing machines, such as screen printing machines or the like, in addition to the offset printing machines.

Therefore, the present examples and embodiments are to be considered as illustrative and not restrictive, and the invention is not to be limited to the details giving herein, but may be modified within the scope of the appended claims.

What is claimed is:

1. An ink washing device for use in a printing machine to wash a plurality of ink rollers, the device comprising:

spraying means for spraying a washing fluid onto at least one of the ink rollers, said spraying means including a plurality of nozzles and fluid supply conduit means for supplying the washing fluid to said nozzles, the fluid supply conduit means including a passage having an outwardly expanding tapered outlet;

air supply conduit means for supplying compressed air to said nozzles; and a swirl chamber communicating with said fluid supply conduit means and with said air supply conduit means, said swirl chamber mixing the compressed air and the washing fluid prior to their expulsion through the spraying means with the outlet of said passage opening into said swirl chamber.

2. The ink washing device according to claim 1, wherein said swirl chamber has a generally cylindrical shape.

3. The ink washing device according to claim 1, further including:

first valve means for regulating the air supply to said spraying means;

second valve means for regulating the washing fluid supply to said spraying means; and wherein said first valve means remains open for a predetermined time after said second valve means is closed.

4. A printing machine including an ink washing device to wash a plurality of ink rollers, the device comprising:

spraying means for spraying a washing fluid onto at least one of the ink rollers, said spraying means including a plurality of nozzles and fluid supply conduit means for supplying the washing fluid to said nozzles, the fluid supply conduit means including a passage having an outwardly expanding tapered outlet;

air supply conduit means for supplying compressed air to said nozzles;

a swirl chamber communicating with said fluid supply conduit means and with said air supply conduit means, said swirl chamber mixing the compressed air and the washing fluid prior to their expulsion through the spraying means with the outlet of said passage opening into said swirl chamber; and drip prevention surfaces formed substantially flat around said nozzles, said drip prevention surfaces reducing the dripping of excess washing fluid.

5. The ink washing device according to claim 4 wherein said swirl chamber has a generally cylindrical shape.

6. The ink washing device according to claim 4, further including;

first valve means for regulating the air supply to said spraying means;

second valve means for regulating the washing fluid supply to said spraying means; and wherein said first valve means remains open for a predetermined time after said second valve means is closed.

7. The ink washing device according to claim 4, wherein said drip prevention surfaces are protruded outwardly relative to the adjacent surfaces.

8. The ink washing device according to claim 7, wherein said drip prevention surfaces are generally circularly shaped.

9. An ink washing device having a spray header arrangement comprising:

a first substantially tubular member having a central bore for conveying washing fluid;

second substantially tubular member journaled about the first tubular member, the second tubular member being flattened along a length of the outer surface thereof with a plurality of spaced apart and raised drip prevention surfaces thereon;

a plurality of nozzles formed in said second tubular member, each nozzle having an associated drip prevention surface;

a plurality of swirl chambers formed between said first and second tubular members, each swirl chamber being located adjacent an associated nozzle for mixing washing fluid with compressed air; and a plurality of passages formed in said first tubular member wherein each passage connects the central bore to an associated swirl chamber.

10. An ink washing device as recited in claim 9 further comprising an air supply groove located adjacent to said plurality of swirl chambers, said air supply groove supplying air to said plurality of swirl chambers.

11. An ink washing device as recited in claim 9 wherein said plurality of drip prevention surfaces are substantially flat.

12. An ink washing device as recited in claim 9 wherein said plurality of passages are taper-shaped.

* * * * *